US009179720B1

(12) United States Patent
Bonadio, Jr.

(10) Patent No.: US 9,179,720 B1
(45) Date of Patent: Nov. 10, 2015

(54) BRIM TEMPLATES, COVERS AND METHODS OF MODIFYING BRIMS ON CAPS AND VISORS

(71) Applicant: JBon Enterprises, Inc., Rockledge, FL (US)

(72) Inventor: Jay Bonadio, Jr., Orlando, FL (US)

(73) Assignee: JBon Enterprises, Inc., Rockledge, FL (US)

( * ) Notice: Subject to any disclaimer, the term of this patent is extended or adjusted under 35 U.S.C. 154(b) by 0 days.

(21) Appl. No.: 13/934,990

(22) Filed: Jul. 3, 2013

Related U.S. Application Data

(60) Provisional application No. 61/668,531, filed on Jul. 6, 2012.

(51) Int. Cl.

| | |
|---|---|
| ***A42B 1/24*** | (2006.01) |
| ***A41D 27/08*** | (2006.01) |
| ***A42B 1/00*** | (2006.01) |
| *A42B 1/18* | (2006.01) |

(52) U.S. Cl.
CPC ..... *A41D 27/08* (2013.01); *A42B 1/004* (2013.01); *A42B 1/18* (2013.01); *A42B 1/248* (2013.01)

(58) Field of Classification Search
CPC ..... A42B 1/18
USPC ..... 40/329; 2/243.1, 244, 171, 209.12, 2/209.13, 175.1, 175.2, 195.1, 10
See application file for complete search history.

(56) References Cited

U.S. PATENT DOCUMENTS

| | | | | |
|---|---|---|---|---|
| 58,907 A | | 10/1866 | Spence | |
| 1,337,506 A | * | 4/1920 | Chew | 2/200.3 |
| 1,373,713 A | | 4/1921 | Schweizer-Caillaux | |
| 1,453,862 A | * | 5/1923 | Check | 2/175.6 |
| 4,192,017 A | | 3/1980 | Fay | |
| 4,258,437 A | * | 3/1981 | Sawatsky | A61F 9/045 2/12 |
| 4,578,822 A | | 4/1986 | Schmidthaler | |
| 4,844,973 A | | 7/1989 | Konishi | |
| 4,850,049 A | * | 7/1989 | Landis | A42B 1/062 2/10 |
| 5,003,639 A | * | 4/1991 | White | A42B 1/24 2/195.1 |
| 5,271,099 A | * | 12/1993 | Lin | A42B 1/24 2/10 |
| 5,701,607 A | * | 12/1997 | Kaiser | 2/209.13 |
| 5,840,408 A | * | 11/1998 | Giansetto | 428/190 |
| 6,272,689 B1 | * | 8/2001 | Kronenberger | A42B 1/248 2/175.1 |
| 6,755,329 B2 | * | 6/2004 | Thompson | A42B 1/002 2/209.13 |
| 2004/0093658 A1 | * | 5/2004 | Jackson | 2/195.1 |
| 2007/0084559 A1 | | 4/2007 | Graziano | |
| 2007/0143906 A1 | * | 6/2007 | Renteria | 2/195.1 |
| 2008/0214079 A1 | | 9/2008 | Harai | |
| 2009/0119819 A1 | * | 5/2009 | Thompson | 2/209.13 |
| 2010/0277944 A1 | * | 11/2010 | Hurwitz | 362/570 |

* cited by examiner

*Primary Examiner* — Andrew W Collins
*Assistant Examiner* — Brieanna Szafran
(74) *Attorney, Agent, or Firm* — Brian S. Steinberger; Law Offices of Brian S. Steinberger, P.A.

(57) ABSTRACT

Brim templates, covers and methods of modifying and changing brims on caps and visors. Novel digitally printed on indicia designs, words and/or colors can be placed on fabric brim covers. The brim covers can have an upper cover with overhanging edges that wrap about perimeter edges of existing hat brim, and a lower cover for covering a lower surface of the existing hat brim. The covers can be attached with by peeling off backing layers that reveal sticky surfaces that allow the covers to be easily attached to existing brims and easily removable from the existing brims without damaging the brims.

16 Claims, 7 Drawing Sheets

BRIM TEMPLATES, COVERS AND METHODS OF MODIFYING BRIMS ON CAPS AND VISORS

CROSS REFERENCE TO RELATED APPLICATIONS

This invention claims the benefit of priority to U.S. Provisional Application Ser. No. 61/668,531 filed Jul. 6, 2012, the entire disclosure of which is incorporated by reference in its' entirety.

FIELD OF INVENTION

This invention relates to headgear apparel, and in particular to brim templates, covers and methods of modifying and changing brims on caps and visors, with customized brim covers having desired indicia such as designs, terms and/or colors.

BACKGROUND AND PRIOR ART

Hats, such as baseball caps, and the visors are popular headgear apparel. Often the baseball cap is purchased to show the name and/or design logo of a favorite sport, team, celebrity, etc.

FIG. 1A is a front view of a prior art baseball cap 1 with visor/brim 20 attached to head portion 4 of the cap 1. FIG. 1B is a bottom view of the prior art cap 1 of FIG. 1A. FIG. 1C is another view of the bottom of the existing brim 2 of FIG. 1B.

A preferred type of hats with brims that can use the invention includes but is not limited to baseball caps 1 and golf type caps having either flat brims or curved brims, as well as visors having brims.

Additionally, caps and visors are often purchased in solid colors, such as white and black. Currently, the colors and existing designs on caps and visors are not changed. As a result individuals can end up having multiple caps and visors having different colors and designs.

Attempts to modify caps and visors are generally not practical since the modifications become permanent. For example, using a marker to add designs and colors becomes a permanent addition to the hats. Patches are also generally permanent since the sewn on patch cannot be easily removed, and the patch only ends up covering a part of hat, and not a complete portion of the hat.

Thus, the need exists for solutions to the above problems with the prior art.

SUMMARY OF THE INVENTION

A primary objective of the present invention is to provide brim templates, covers and methods of modifying and changing brims on caps and visors in order to customize brims with different designs and/or colors.

A secondary objective of the present invention is to provide brim templates, covers and methods of modifying and changing brims on caps and visors without permanently damaging the underlying hat.

A third objective of the present invention is to provide brim templates, covers and methods of modifying and changing brims on caps and visors with interchangeable brims.

An attachable brim template for changing an existing brim on headwear, can include an upper cover panel template having an arc curved shape with an upper surface having an exposed surface with indicia thereon, the upper cover panel for covering an upper exposed surface of an existing brim on headwear, a first removable layer for covering an adhesive surface underneath the upper cover panel template, a lower cover panel template having an arc shape with an exposed surface with the indicia thereon, for covering a lower exposed surface of the existing brim on the headwear, and a second removal layer on one side of the lower cover for covering an adhesive surface on the bottom cover template, wherein removing the first removable layer allows for attaching the adhesive surface of the upper cover panel template to substantially cover the upper exposed surface of the brim on the headwear, and wherein removing the second removable layer allows for attaching the adhesive surface of the bottom cover template to substantially cover the lower exposed surface on the brim of the headwear.

The upper cover panel template can include tab edges for bending about perimeter edges of the existing brim on the headwear. The lower cover panel template can have a perimeter consisting of a front end and a rear end, the front end having an arc shape that includes a left side and a right side. The front end of the lower cover panel template having a smooth surface along an outer perimeter of the arc shape and the rear end of the lower cover panel template having a smooth arcuate surface. The headwear can be a cap with the existing brim. The headwear can be a visor only as the existing brim.

The first removable layer and the second removable layer can be a paper sheet. The first removable layer and the second removable layer can be peel and stick layers.

The upper cover panel template and the lower cover panel template can be fabric, with or without a waterproof coating. The upper cover panel template and the lower cover panel template can include a digital print and/or a customized indicia thereon.

A method for modifying brims on headwear, can include the steps of providing a top brim cover template sized to cover substantially all of an upper surface of an existing brim on a headwear, providing a lower brim cover template sized to cover substantially all of a bottom surface of the existing brim on the headwear, attaching the top brim template to the upper surface on the existing brim on the headwear, and attaching the lower brim template to the bottom surface of the existing brim on the headwear.

The attaching steps can include the steps of removing peel and stick layers from one side of the top brim template and from one side of the lower brim cover template to reveal an adhesive surface, pressing the adhesive surface of the top brim template to the upper surface on the existing brim, and pressing the adhesive surface of the lower brim template to the bottom surface on the existing brim.

The method can include the steps of providing tab edges about a perimeter of the top brim template, and bending the tab edges underneath the existing brim.

In one embodiment there is provided a method for manually transforming brims on headwear, comprising the steps of:

providing a top brim cover template sized to cover substantially all of an upper surface of an existing brim on a headwear;

providing the top brim cover template with a front end, a left side, a right side and a rear end, the front end of the top brim cover template having a convex curved outer perimeter with a plurality of side by side tabs substantially adjacent to one another, and the plurality of side by side tab edges continuously extending from the left side of the top brim cover template to the right side of the top brim cover template, each of the side by side tabs being separated by one another by a cut that consists of two straight lines that are each joined together at one end, providing the plurality of side by side tabs with a right end tab and a left end tab that are substantially different in shape and size from all other ones of the plurality of side by side tabs, providing the rear end of the brim cover template consisting of a single, continuous smooth arcuate surface between the right end tab and the left end tab;

positioning the single, smooth arcuate surface against a surface where the existing brim meets a crown portion of the headwear;

providing a lower brim cover template sized to cover substantially all of a bottom surface of the existing brim on the headwear, providing the lower brim cover template with a perimeter consisting of a front end and a rear end;

the front end of the lower brim cover template having a smooth arc surface; and the rear end of the lower brim cover template having a smooth arcuate surface;

manually attaching the top brim cover template to the upper surface on the existing brim on the headwear;

manually bending the plurality of the side by side tabs underneath a front portion of the existing brim;

manually attaching the lower brim template to the bottom surface of the existing brim on the headwear;

manually covering the bent plurality side by side tabs with the lower brim template;

wherein the attaching steps include the steps of:

manually removing peel and stick layers from one side of the top brim template and from one side of the lower brim cover template to reveal an adhesive surface; and manually pressing the adhesive surface of the top brim template to the upper surface on the existing brim; and manually pressing the adhesive surface of the lower brim template to the bottom surface on the existing brim.

A brim modifying kit for modifying an existing brim on headwear, can include an upper cover panel for adhering to an upper surface of the existing brim, and a lower cover panel for adhering to a lower surface of the existing brim.

The upper cover panel can include overhanging edges which wrap about edges of the existing brim so that the lower cover panel covers the wrapped out perimeter portions of the upper cover.

The upper cover panel and the lower cover panel can each include a peel and stick backing for allowing each cover panel to be attached to the existing brim.

The headwear can be a cap with the brim. The headwear can be a visor as the brim without a head covering portion. The upper cover panel and the lower cover panel can each include customized indicia thereon.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1A:
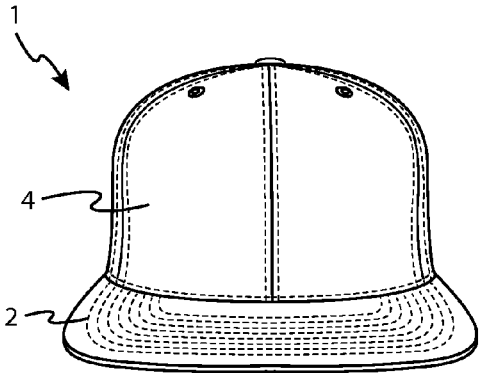
FIG. 1A is a front view of a prior art cap with existing brim.
Figure 1B:
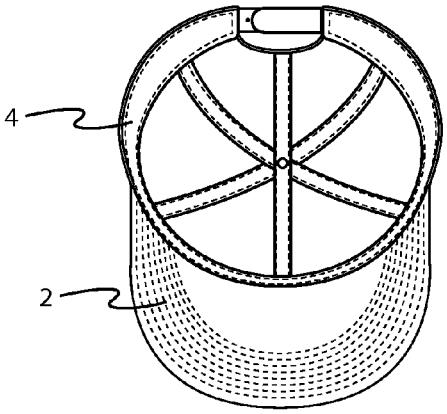
FIG. 1B is a bottom view of the prior art cap with existing brim of FIG. 1A.
Figure 1C:
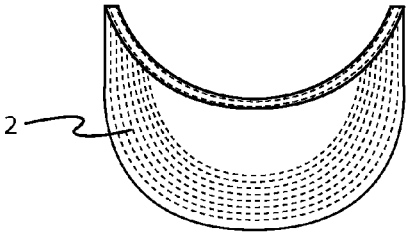
FIG. 1C is another view of the bottom of the existing brim of FIG. 1B.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A list of components from the figures will now be described.

1. prior art baseball cap
2. existing visor on baseball cap
4. head cover portion of baseball cap
10. top brim replacement template cover
12. upper cover for brim
13. inner concave curved edge
14. tab edges
14*x*. right end tab
14*y*. left end tab
15. outer convex curved edge
16. lower peel and stick layer
17. rear end of upper cover
18. front end of upper cover
18*a*. right side of upper cover
18*b*. left side of upper cover
19. cut
20. bottom brim template cover
21. front end of bottom cover
21*a*. right side of bottom cover
21*b*. left side of bottom cover
22. bottom exposed cover
23. inner concave curved edge
24. rear end of bottom cover
25. outer convex curved edge
26. removable peel and stick layer The novel invention uses both a top brim template 10 and a bottom brim template 20. The novel replacement brim template covers 10 and 20 can have selected indicia placed thereon such as but not limited to digital or other printing on a fabric, plastic, or any other layer material. The novel brims can be customized with different indicia, such as but not limited to different designs, sports teams, sports memorabilia, animal prints, different colors, combinations, thereof, and the like.

Figure 2A:
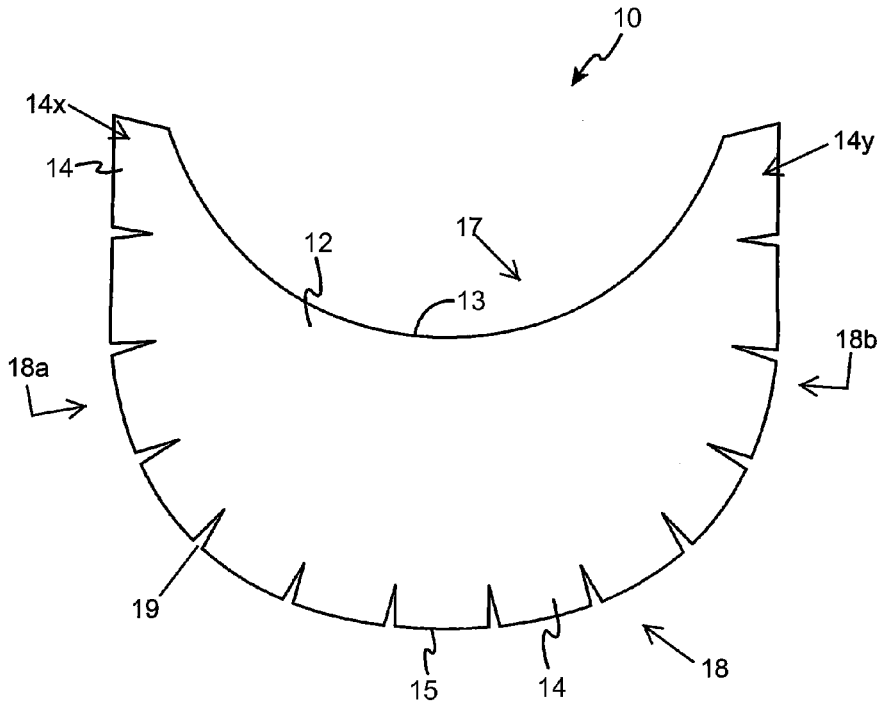
FIG. 2A shows the top cover of the novel replacement top brim template cover with the outer lip tab edges.
Figure 2B:
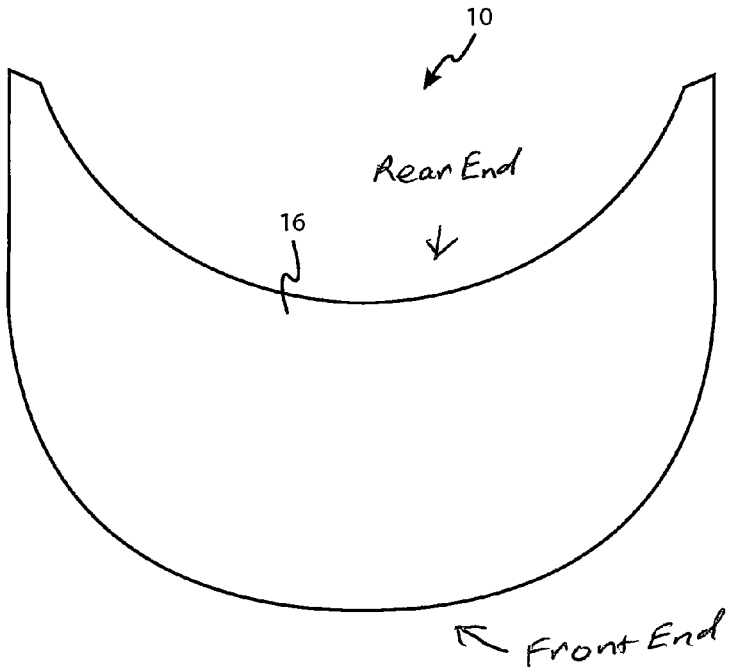
FIG. 2B shows the bottom peel and stick layer of the top brim template cover of FIG. 2A.

FIG. 2A shows the top cover 12 of the novel replacement top brim template cover 10 with the outer lip tab edges 14. FIG. 2B shows the bottom peel and stick layer 16 the top brim template 10 of FIG. 2A.

Referring to FIGS. 2A-2B, the top brim template cover 10 can be formed from a fabric or nylon or cotton, and the like material, and can optionally have a waterproof coating. The exposed visible surface of the top cover 12 of the top brim template 10, can have a customized indicia thereon, such as but not limited to different designs, sports teams, sports memorabilia, animal prints, and the like. The top brim template cover 10 can have a generally arc shape to conform to the brims on existing baseball and golf type hats, with an inner concave edge 13 and an outer convex edge 15. The top brim template cover 10 can consist of a single material layer and a plurality of side by side tabs 14, the template 10 having an arc curved shape on a front end 18, a left side 18*b*, a right side 18*a* and a rear end 17. The tab edges 14 can be formed by cutting small triangular cuts approximately 1 inch in from the outer edge 15. The front end of the top brim template cover 10 having a convex curved outer perimeter portion with the plurality of side by side tabs 14 substantially adjacent to one another, and the plurality of side by side tabs 14 continuously extending from the left side 18*b* of the template around the front end 18 to the right side 18*a* of the template. Each of the side by side tabs 14 can be separated by one another by a cut 19 that consists of two straight lines that are each joined together at one end. The plurality of side by side tabs 14 include a right end tab 14*x* and a left end tab 14*y* that are substantially different in shape and size from all other ones of the plurality of side by side tabs 14. The rear end 17 of the top brim cover template 10 can consist of a single, continuous smooth arcuate surface between the right end tab 14*x* and the left end tab 14*y*. The single, continuous smooth arcuate surface of the rear end 17 of the top brim cover template 10 can be positioned against a surface where the existing brim meets a crown portion of the headwear. The template can be approximately 5 and ¼ inches on the sides approximately 2 inches from center and be approximately 7 inches across the template cover 12 from the left side to the right side. There is an extra ½" around the entire design to wrap around to the bottom of the brim.

Underneath the top cover 10 can be a removable peel and stick paper type layer 16, which reveals a sticky adhesive layer under the top cover 12. The removable paper type layer 16 can be sized to substantially cover the undersurface of the top cover 12. A double sided adhesive tape with paper layers can be used that works with fabric materials, where the adhesive is pressure and/or heat activated. Such adhesive tape can include but is not limited to those described in U.S. Pat. No. 4,884,973 to Konishi et al.; and U.S. Patent Application Publications: 2007/0084559 to Graziano; and 2008/0214079 to Harai et al., which are each incorporated by reference in their entirety.

Figure 3A:
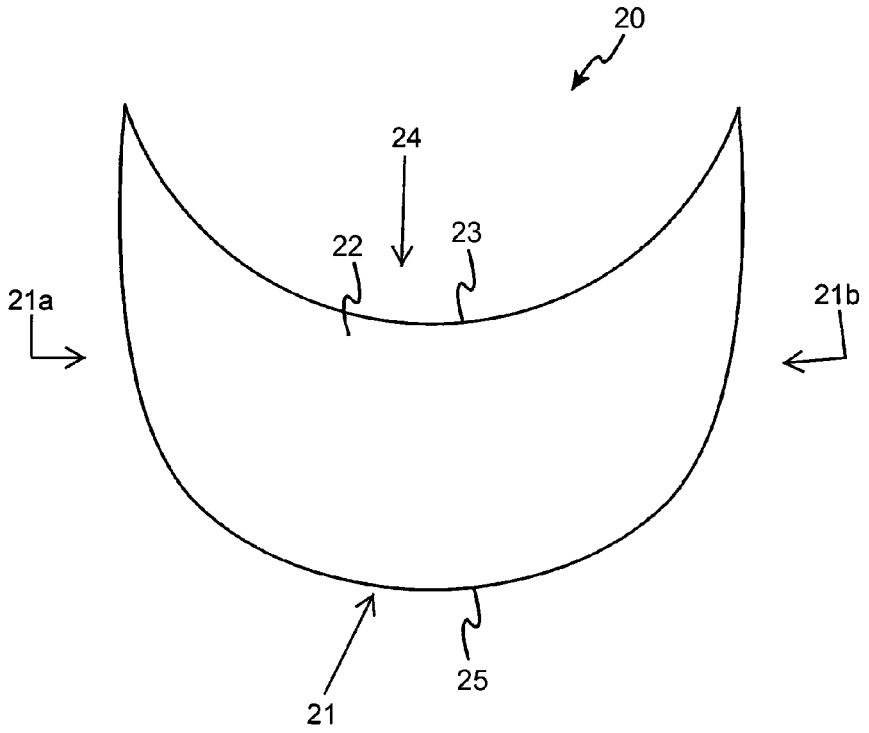
FIG. 3A shows the bottom cover of the novel replacement bottom brim template cover.
Figure 3B:
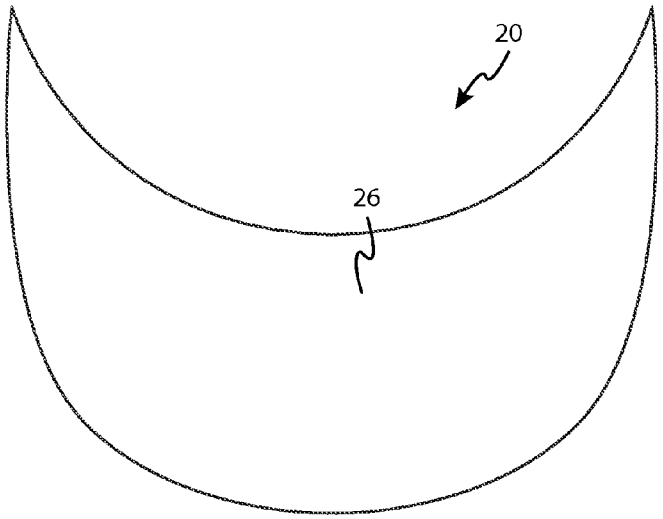
FIG. 3B shows the peel and stick layer for the bottom brim template cover.

FIG. 3A shows the bottom cover 22 of the novel replacement bottom brim template cover 20. FIG. 3B shows the peel and stick layer 26 for the bottom brim template cover 20.

Referring to FIGS. 3A-3B, the bottom brim template cover 20 can also be formed from a fabric or nylon or cotton, and the like material, and can optionally have a waterproof coating. The exposed visible surface of the bottom cover 22 of the bottom brim template cover 20, can have a customized indicia thereon, such as but not limited to different designs, sports teams, sports memorabilia, animal prints, and the like. The bottom brim template cover 20 can have a generally arc shape to conform to the brims on existing baseball and golf type hats, with an inner concave edge 23 designating a rear end 24 and an outer convex edge 25 designating a front end. The outer convex edge 25 further includes a left side 21*b* and a right side 21*a*. The front end 21 having a smooth surface along an outer perimeter of the arc shape and the rear end 24 having a smooth arcuate surface. The template cover 20 can be sized smaller than the top template cover 10 without the extra dimensions for the tab edges 14, since there are no tab edges on the bottom template cover 20.

On the other side of the bottom template cover 20 can be a removable peel and stick paper type layer 26, which reveals a sticky adhesive layer under the bottom cover 22 The removable paper type layer 26 can be sized to substantially cover the undersurface of the bottom cover 22.

Figure 4A:
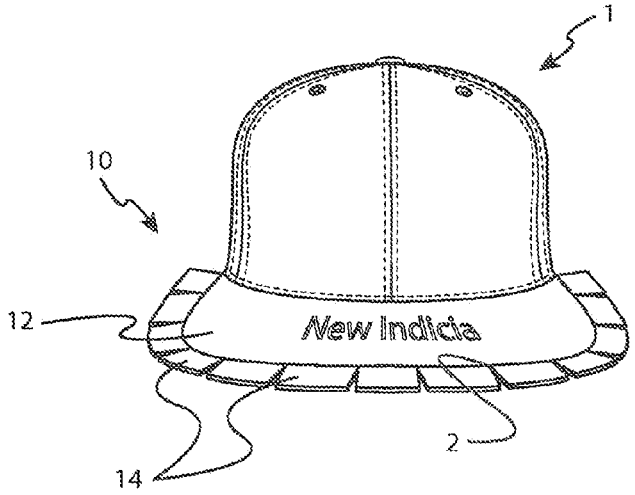
FIG. 4A is a front view of a cap with the top template cover starting to be applied to the visor on the hat.
Figure 4B:
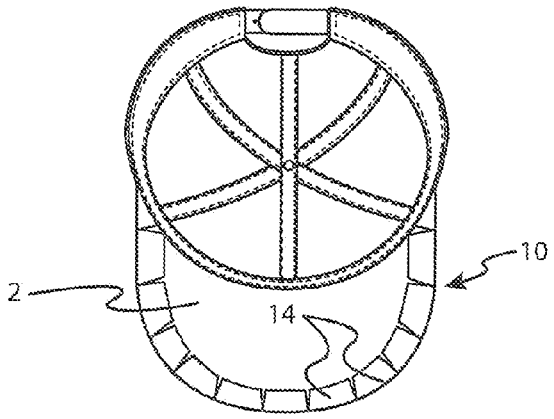
FIG. 4B is a bottom view of the tab edges being bent around the perimeter of the visor on the hat of FIG. 4A.

FIG. 4A is a front view of a cap 1 having the top template cover 10 starting to be applied to the visor 2 on the hat 10. FIG. 4B is a bottom view of the tab edges 14 being bent around the perimeter of the visor 2 on the hat 1.

Referring to FIGS. 2A, 2B, 4A and 4B, a user can remove the paper type layer 16 revealing a sticky (adhesive) surface of the top cover 12 of the top brim template cover 10. With the visor/brim 2 positioned on a flat surface, the user can position the top cover 12 over the existing visor/brim 2 on the hat 1, so that the tab edges 14 extend over the perimeter edges of the visor/brim 2. Next, the user can press down making sure the top cover 12 covers all of the existing upper surface of the visor/brim 2 on the hat by carefully pressing down.

If necessary, the user can trim the edges of the top brim cover 12 so that the top brim cover substantially fits on, conforms to, and covers all of the existing upper surface of the brim/visor 2 on the hat 1.

Next, the user can bend the tab edges 14 underneath the visor/brim 2 so that their sticky undersurface adheres to the undersurface of the visor/brim 2.

Figure 5A:
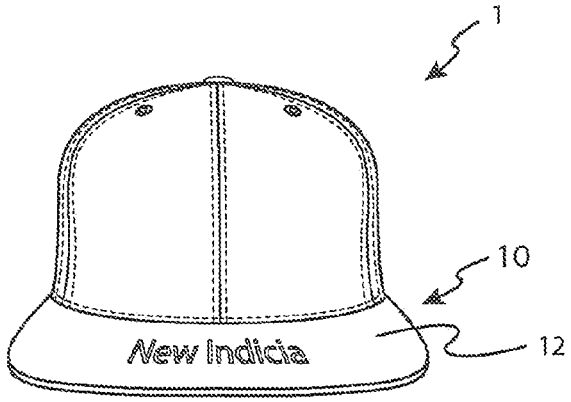
FIG. 5A is a front view of the cap with the top brim template fully installed.
Figure 5B:
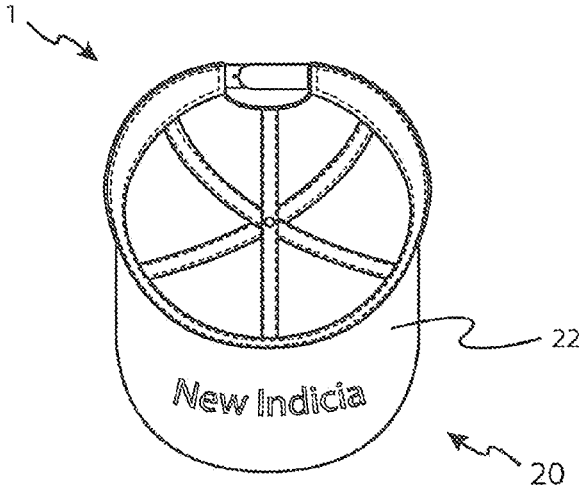
FIG. 5B is a bottom view of the hat with the bottom template cover installed.

FIG. 5A is a front view of the cap 1 with the top brim template 10 fully installed. FIG. 5B is a bottom view of the hat 1 with the bottom template cover 20 installed.

Referring to FIGS. 3A, 3B, 5A and 5B, after the top template cover 10 is installed, the user positions the hat 1 upside down so that the visor/brim 2 with installed top template cover 10 is against a flat surface. Next, the user removes the peel and stick paper layer 26 from the bottom template cover 20 revealing a sticky (adhesive) surface on one side of the bottom cover 22. The user then positions the bottom cover 12 so that the sticky surface is pressed against the bottom of the visor/brim 2, effectively covering the bent tab edges 14. If necessary, the user can trim the edges of the bottom brim cover 22 so that the bottom brim cover substantially fits on, conforms to and covers all of the existing bottom surface of the brim/visor 2 on the hat 1.

When finished the visor/brim 2 of the hat 1 has a completely new exposed indicia surface that has been customized by the user. The indicia can include any type of text, image, artwork, combinations thereof, and the like.

The novel replacement brim template covers 10, 20 can be marketed in a kit. A kit can include a two piece set having an upper template cover 10 with overhanging edges 14 and a lower template cover 20. Both the upper cover and the lower cover can have a removable backing layer that can each be peeled off to reveal a sticky (reusable adhesive) layer surface. The sticky layer surface of the upper cover can be fit over the top of the existing hat brim so that the perimeter edges can overhang about the perimeter edges of the existing hat brim and folded back. Next the sticky surface of the lower cover can be fit over the bottom surface of the existing hat brim so that it covers the folded back portions of the top cover.

The peel and stick backings also allow for the brim covers to be easily peeled off of the existing brims and changed out with different replacement brim covers without causing damage to the underlying existing brims.

Other types of fasteners can also be used to attach the replacement brim covers to existing brims, can include such as but not limited to hook and loop fasteners (such as Velcro®) or snap fasteners, and the like.

The adhesive layer and/or the other types of fasteners, allow for the template covers to be removable from the existing brims without destroying the existing brims.

Although the embodiment shows a hat portion with the visor/brim, the invention can be used just with visors/brims that have straps that attach about one's head without a head type covering portion.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An attachable decorative brim assembly for changing an existing brim on headwear, comprising in combination:

an upper cover panel template consisting of a single material layer and a plurality of side by side tabs, the upper cover panel template having an arc curved shape on a front end, a left side, a right side and a rear end, the upper cover panel template having an upper exposed surface with indicia thereon, the upper cover panel template for covering an upper exposed surface of an existing brim on headwear, the front end of the upper cover panel template having a convex curved outer perimeter portion with the plurality of side by side tabs substantially adjacent to one another, and the plurality of side by side tabs continuously extending from the left side of the upper cover panel template around the front end of the upper cover panel template to the right side of the upper cover panel template, each of the side by side tabs being separated by one another by a cut that consists of two straight lines that are each joined together at one end, the plurality of side by side tabs include a right end tab and a left end tab that are substantially different in shape and size from all other ones of the plurality of side by side tabs, and the rear end of the upper panel cover template consisting of a single, continuous smooth arcuate surface between the right end tab and the left end tab, wherein the single, continuous smooth arcuate surface is positioned against a surface where the existing brim meets a crown portion of the headwear;

a first removable layer for covering an adhesive surface underneath the upper cover panel template;

a lower cover panel template with a perimeter consisting of a front end and a rear end, the front end of the lower cover panel template having an arc shape that includes a left side and a right side, with the lower cover panel template having an exposed surface with the indicia thereon, for covering a lower exposed surface of the existing brim on the headwear;

the front end of the lower cover panel template having a smooth surface along an outer perimeter of the arc shape and the rear end of the lower cover panel template having a smooth arcuate surface, a second removal layer on one side of the lower cover panel template for covering an adhesive surface on the lower cover panel template, wherein removing the first removable layer allows for attaching the adhesive surface of the upper cover panel template to substantially cover the upper exposed surface of the brim on the headwear, and bending the plurality of the side by side tabs about a perimeter of a front portion of the existing brim, and wherein removing the second removable layer allows for attaching the adhesive surface of the lower cover panel template to substantially cover the lower exposed surface on the brim of the headwear and cover the bent plurality of the side by side tabs.

2. The attachable decorative brim assembly of claim 1, wherein the headwear is a cap with an existing brim.

3. The attachable decorative brim assembly of claim 1, wherein the headwear is a visor with an existing brim.

4. The attachable decorative brim assembly of claim 1, wherein the first removable layer and the second removable layer include: a paper sheet.

5. The attachable decorative brim assembly of claim 1, wherein the first removable layer and the second removable layer are peel and stick layers.

6. The attachable decorative brim assembly of claim 1, wherein the upper cover panel template and the lower cover panel template includes: a fabric.

7. The attachable decorative brim assembly of claim 1, wherein the upper cover panel template and the lower cover panel template includes: a waterproof coating.

8. The attachable decorative brim of claim 1, wherein the upper cover panel template and the lower cover panel template includes: a digital print.

9. The attachable decorative brim assembly of claim 1, wherein the upper cover panel template and the lower cover panel template includes: a customized indicia thereon.

10. A method for manually transforming brims on headwear, comprising the steps of:

providing a top brim cover template sized to cover substantially all of an upper surface of an existing brim on a headwear;

providing the top brim cover template with a front end, a left side, a right side and a rear end, the front end of the top brim cover template having a convex curved outer perimeter with a plurality of side by side tabs substantially adjacent to one another, and the plurality of side by side tab edges continuously extending from the left side of the top brim cover template to the right side of the top brim cover template, each of the side by side tabs being separated by one another by a cut that consists of two straight lines that are each joined together at one end, providing the plurality of side by side tabs with a right end tab and a left end tab that are substantially different in shape and size from all other ones of the plurality of side by side tabs, providing the rear end of the top brim cover template consisting of a single, continuous smooth arcuate surface between the right end tab and the left end tab;

positioning the single, continuous smooth arcuate surface against a surface where the existing brim meets a crown portion of the headwear, providing a lower brim cover template sized to cover substantially all of a bottom surface of the existing brim on the headwear;

providing the lower brim cover template with a perimeter consisting of a front end and a rear end;

the front end of the lower brim cover template having a smooth arc surface; and the rear end of the lower brim cover template having a smooth arcuate surface;

manually attaching the top brim cover template to the upper surface on the existing brim on the headwear;

manually bending the plurality of the side by side tabs underneath a front portion of the existing brim;

manually attaching the lower brim template to the bottom surface of the existing brim on the headwear; and manually covering the bent plurality of the side by side tabs with the lower brim template.

11. The method of claim 10, wherein the attaching steps include the steps of:

manually removing peel and stick layers from one side of the top brim cover template and from one side of the lower brim cover template to reveal an adhesive surface; and manually pressing the adhesive surface of the top brim cover template to the upper surface on the existing brim; and manually pressing the adhesive surface of the lower brim cover template to the bottom surface on the existing brim.

12. A brim modifying kit for modifying an existing brim on headwear, comprising;

an upper cover panel with a front end, a left side, a right side, and a rear end, the upper cover panel consisting of a single material layer and a plurality of overhanging side by side tab edges for adhering to an upper surface of the existing brim, the front end of the upper cover panel having a convex curved perimeter, the upper cover panel having an upper exposed surface with indicia thereon, and with the plurality of the overhanging side by side tab edges directly adjacent to one another, the side by side tab edges continuously and extending from the left side of the upper cover panel around the front end of the upper cover panel to the right side of the upper cover panel, each of the plurality of the side by side tab edges being separated by one another by a cut that consists of two straight lines that are each joined together at one end, the plurality of side by side tab edges include a right end tab edge and a left end tab edge that are substantially different in shape and size from all other ones of the plurality of side by side tab edges, the rear end of the upper cover panel consisting of a single, continuous smooth arcuate surface between the right end tab edge and the left end tab edge, wherein the single, continuous smooth arcuate surface is positioned against a surface where the existing brim meets a crown portion of the headwear, wherein the plurality of the side by side tab edges are bent over to a lower surface of the existing brim; and a lower cover panel for adhering to the lower surface of the existing brim covering the bent overhanging plurality of side by side tab edges, wherein the lower cover panel having a perimeter consisting of a front end and a rear end, the front end of the lower cover panel having a smooth arc surface; and the rear end of the lower cover panel having a smooth arcuate surface.

13. The kit of claim 12, wherein the upper cover panel and the lower cover panel each include: a peel and stick backing for allowing each cover panel to be attached to the existing brim.

14. The kit of claim 12, wherein the headwear includes a cap with a brim.

15. The kit of claim 12, wherein the headwear includes a visor as a brim without a head covering portion.

16. The kit of claim 12, wherein the upper cover panel and the lower cover panel both include: customized indicia thereon.

* * * * *